US009517393B2

(12) United States Patent
Cardani et al.

(10) Patent No.: US 9,517,393 B2
(45) Date of Patent: Dec. 13, 2016

(54) HOLLOW GOLF CLUB HEAD WITH POLYMERIC CAP

(71) Applicant: NIKE, Inc., Beaverton, OR (US)

(72) Inventors: Jason Cardani, Portland, OR (US); Matt Daraskavich, Grapevine, TX (US); Brian Kammerer, Fort Worth, TX (US); Pedro Maldonado, Dallas, TX (US); Michael Pinto, Fort Worth, TX (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 14/708,620

(22) Filed: May 11, 2015

(65) Prior Publication Data

US 2016/0332043 A1 Nov. 17, 2016

(51) Int. Cl.
*A63B 53/04* (2015.01)

(52) U.S. Cl.
CPC ..... *A63B 53/0475* (2013.01); *A63B 2053/045* (2013.01); *A63B 2053/0408* (2013.01); *A63B 2053/0412* (2013.01)

(58) Field of Classification Search
CPC ..... A63B 53/0475
See application file for complete search history.

(56) References Cited

U.S. PATENT DOCUMENTS 4,645,207 A 2/1987 Teramoto et al.
4,824,110 A 4/1989 Kobayashi
D320,056 S 9/1991 Antonious
D327,308 S 6/1992 Antonious
5,290,032 A 3/1994 Fenton et al.
5,328,184 A 7/1994 Antonious
5,447,311 A 9/1995 Viollaz et al.
6,030,295 A 2/2000 Takeda
D428,632 S 7/2000 Besnard et al.
6,093,112 A 7/2000 Peters et al.
6,183,376 B1 2/2001 Peters et al.
D438,925 S 3/2001 Adams et al.
6,358,158 B2 3/2002 Peters et al.
D473,606 S 4/2003 Mickelson et al.
6,551,200 B1 * 4/2003 Golden ..... A63B 53/04 473/349
6,554,719 B2 4/2003 Peters et al.
D487,127 S 2/2004 Madore
6,830,519 B2 12/2004 Reed et al.
6,863,625 B2 3/2005 Reyes et al.
6,942,580 B2 9/2005 Hou et al.
6,981,924 B2 1/2006 Deshmukh
7,004,853 B2 2/2006 Deshmukh
7,022,031 B2 4/2006 Nishio
7,025,693 B2 4/2006 Sugimoto
(Continued)

*Primary Examiner* — Gene Kim
*Assistant Examiner* — Jeffrey Vanderveen
(74) *Attorney, Agent, or Firm* — Quinn Law Group, PLLC

(57) ABSTRACT

A hollow golf club head includes a metallic body, a club face, and a polymeric insert that cooperate to at least partially define a closed internal cavity. The metallic body includes a sole, a topline, and a rear wall defining an opening, with the rear wall being disposed between the topline and the sole. The club face is disposed between the topline and the sole, and on an opposite side of the sole from the rear wall. A strut extends across the opening and is secured to the body, and a polymeric insert covers the opening and is secured both to the body and to the strut.

17 Claims, 3 Drawing Sheets

(56) References Cited

U.S. PATENT DOCUMENTS

| | | | |
|---|---|---|---|
| 7,112,148 | B2 | 9/2006 | Deshmukh |
| 7,137,903 | B2 | 11/2006 | Best et al. |
| 7,147,571 | B2 | 12/2006 | Best et al. |
| 7,186,188 | B2 | 3/2007 | Gilbert et al. |
| 7,192,361 | B2 | 3/2007 | Gilbert et al. |
| 7,192,362 | B2 | 3/2007 | Gilbert et al. |
| 7,232,377 | B2 | 6/2007 | Gilbert et al. |
| 7,273,418 | B2 | 9/2007 | Gilbert et al. |
| 7,371,190 | B2 | 5/2008 | Gilbert et al. |
| D571,421 | S | 6/2008 | Clausen et al. |
| 7,485,049 | B2 | 2/2009 | Gilbert et al. |
| 7,662,050 | B2 | 2/2010 | Gilbert et al. |
| 7,686,704 | B2 | 3/2010 | Gilbert et al. |
| 7,803,062 | B2 | 9/2010 | Gilbert et al. |
| 7,942,760 | B2 | 5/2011 | Best et al. |
| 8,033,927 | B2 | 10/2011 | Gilbert et al. |
| 8,088,025 | B2 | 1/2012 | Wahl et al. |
| 8,182,359 | B2 | 5/2012 | Gilbert et al. |
| 8,197,354 | B2 | 6/2012 | Gilbert et al. |
| 8,202,174 | B2 | 6/2012 | Breier et al. |
| 8,235,833 | B2 | 8/2012 | Best et al. |
| 8,298,095 | B2 | 10/2012 | Gilbert et al. |
| 8,328,663 | B2 | 12/2012 | Wahl et al. |
| 8,353,785 | B2 | 1/2013 | Ines et al. |
| 8,475,293 | B2 | 7/2013 | Morin et al. |
| 8,480,507 | B2 | 7/2013 | Finn et al. |
| 8,512,164 | B2 | 8/2013 | Ines et al. |
| 8,517,863 | B2 | 8/2013 | Wahl et al. |
| 8,535,176 | B2 | 9/2013 | Bazzel et al. |
| 8,758,159 | B2 | 6/2014 | Morin et al. |
| 8,777,776 | B2 | 7/2014 | Wahl et al. |
| 8,814,725 | B2 | 8/2014 | Wahl et al. |
| 8,920,258 | B2 | 12/2014 | Dolezel et al. |
| 8,920,261 | B2 | 12/2014 | Taylor et al. |
| 8,932,150 | B2 | 1/2015 | Ines et al. |
| 2007/0117653 | A1* | 5/2007 | Yoneyama ..... A63B 53/0475 473/350 |
| 2007/0207878 | A1* | 9/2007 | Tavares ..... A63B 53/047 473/346 |
| 2007/0293343 | A1 | 12/2007 | Lai et al. |
| 2012/0289360 | A1* | 11/2012 | Breier ..... A63B 53/047 473/335 |
| 2013/0017904 | A1 | 1/2013 | Woolley et al. |
| 2013/0252754 | A1 | 9/2013 | Bazzel et al. |
| 2013/0331201 | A1 | 12/2013 | Wahl et al. |
| 2014/0206469 | A1 | 7/2014 | Girard et al. |
| 2014/0248977 | A1 | 9/2014 | Morin et al. |
| 2014/0302944 | A1 | 10/2014 | Roach et al. |
| 2014/0364248 | A1 | 12/2014 | Wahl et al. |

* cited by examiner

HOLLOW GOLF CLUB HEAD WITH POLYMERIC CAP

TECHNICAL FIELD

The present invention relates generally to a hollow iron-type golf club head with a structural polymeric cap.

BACKGROUND

A golf club may generally include a club head disposed on the end of an elongate shaft. During play, the club head may be swung into contact with a stationary ball located on the ground in an effort to project the ball in an intended direction and with a desired vertical trajectory.

Many design parameters must be considered when forming a golf club head. For example, the design must provide enough structural resilience to withstand repeated impact forces between the club and the ball, as well as between the club and the ground. The club head must conform to size requirements set by different rule setting associations, and the face of the club must not have a coefficient of restitution above a predefined maximum (measured according to applicable standards). Assuming that certain predefined design constraints are satisfied, a club head design for a particular loft can be quantified by the magnitude and location of the center of gravity, as well as the head's moment of inertia about the center of gravity and/or the shaft.

The club's moment of inertia relates to the club's resistance to rotation (particularly during an off-center hit), and is often perceived as the club's measure of "forgiveness." In typical club designs, high moments of inertia are desired to reduce the club's tendency to push or fade a ball. Achieving a high moment of inertia generally involves moving mass as close to the perimeter of the club as possible (to maximize the moment of inertia about the center of gravity), and as close to the toe as possible (to maximize the moment of inertia about the shaft). In iron-type golf club heads, this desire for increased moments of inertia have given rise to designs such as the cavity-back club head and the hollow club head.

While the moment of inertia affects the forgiveness of a club head, the location of the center of gravity behind the club face (and above the sole) generally affects the trajectory of a shot for a given face loft angle. A center of gravity that is positioned as far rearward (away from the face) and as low (close to the sole) as possible typically results in a ball flight that has a higher trajectory than a club head with a center of gravity placed more forward and/or higher.

While a high moment of inertia is obtained by increasing the perimeter weighting of the club head or by moving mass toward the toe, an increase in the total mass/swing weight of the club head (i.e., the magnitude of the center of gravity) has a strong, negative effect on club head speed and hitting distance. Said another way, to maximize club head speed (and hitting distance), a lower total mass is desired; however a lower total mass generally reduces the club head's moment of inertia (and forgiveness).

In the tension between swing speed (mass) and forgiveness (moment of inertia), it may be desirable to place varying amounts of mass in specific locations throughout the club head to tailor a club's performance to a particular golfer or ability level. In this manner, the total club head mass may generally be categorized into two categories: structural mass and discretionary mass.

Structural mass generally refers to the mass of the materials that are required to provide the club head with the structural resilience needed to withstand repeated impacts. Structural mass is highly design-dependent, and provides a designer with a relatively low amount of control over specific mass distribution. On the other hand, discretionary mass is any additional mass that may be added to the club head design for the sole purpose of customizing the performance and/or forgiveness of the club. In an ideal club design, the amount of structural mass would be minimized (without sacrificing resiliency) to provide a designer with a greater ability to customize club performance, while maintaining a traditional or desired swing weight.

Specifically as to iron designs, discretionary mass is typically placed as far from the shaft as possible (i.e., toward the toe portion), and as far from the face as possible (i.e., to the rear of the head). This tends to provide a club head having a high moment of inertia (forgiveness) and a generally higher launch angle.

SUMMARY

A hollow golf club head includes a metallic body, a club face, and a polymeric insert that cooperate to at least partially define a closed internal cavity that may have a volume of from about 20 cc to about 120 cc. The golf club is preferably an iron-type golf club having a loft angle of from about 17 degrees to about 60 degrees. In general, the metallic body includes a sole, a topline, and a rear wall that defines an opening. The club face is disposed between the topline and the sole, and on an opposite side of the sole from the rear wall.

A strut extends across the opening and is secured to the body, and a polymeric insert covers the opening and is secured both to the body and to the strut. The polymeric insert may extend to opposing sides of the strut, where it may be adhered. The strut may generally divide the opening into a first opening and a second opening. At least one of the openings may be oriented such that a vector that is normal to the at least one opening intersects the face. The first opening and the second opening may have a combined area of from about 800 $mm^2$ to about 1200 $mm^2$.

In one configuration, the body includes a first bond area and a second bond area. The first bond area is generally disposed within 45 degrees of parallel to the opening, and the second bond area is within 45 degrees of perpendicular to the opening. The polymeric insert is adhered to both the first bond area and the second bond area using an adhesive. The first bond area may predominantly rely on the tensile/peel strength of the adhesive to restrain the insert, and the second bond area may predominantly rely on the sheer strength of the adhesive to restrain the insert. The ratio of the size of the second bond area to the size of the first bond area may be from about 0.7:1 to about 2.0:1.

The above features and advantages and other features and advantages of the present technology are readily apparent from the following detailed description when taken in connection with the accompanying drawings.

DETAILED DESCRIPTION

Figure 1:
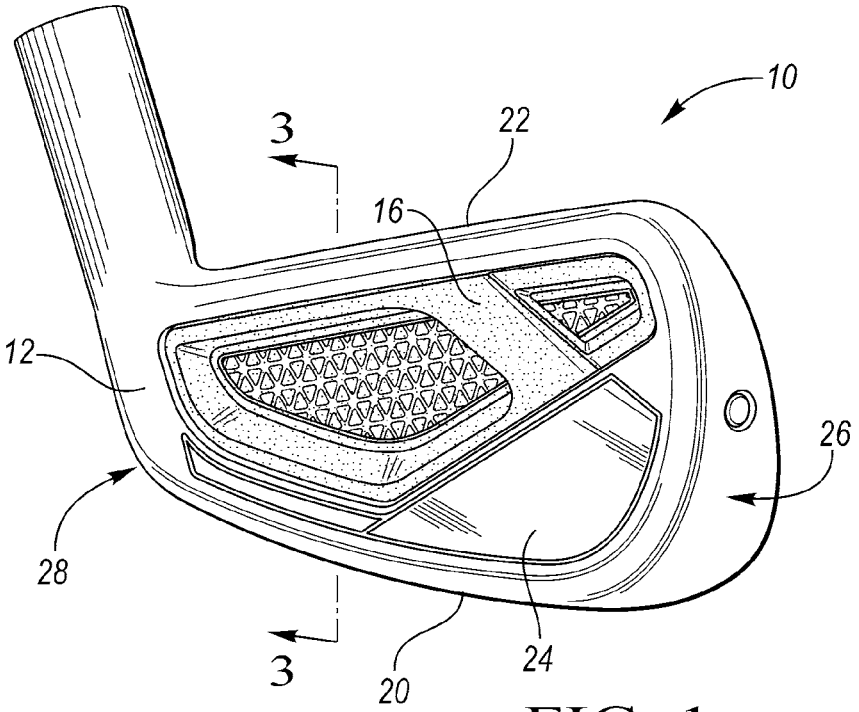
FIG. 1 is a schematic perspective view of the rear portion of an iron-type, hollow golf club head.
Figure 2:
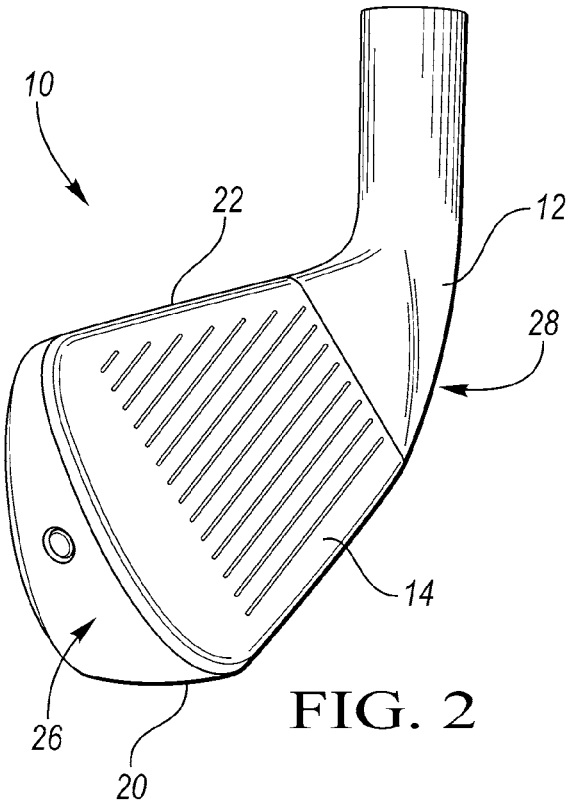
FIG. 2 is a schematic perspective view of the face portion of the golf club head of FIG. 1.
Figure 3:
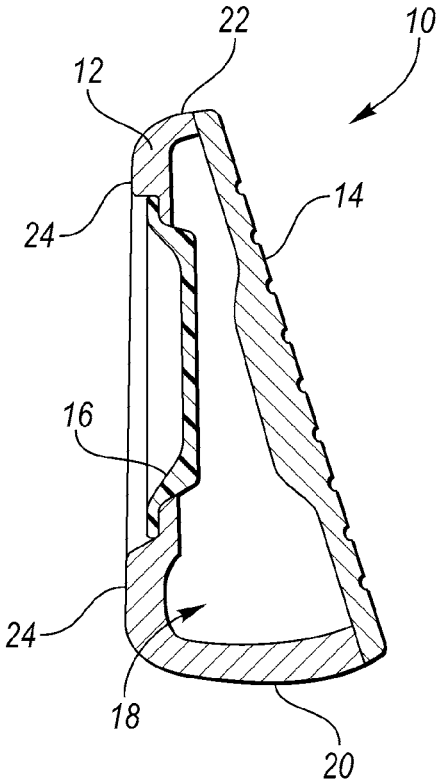
FIG. 3 is a schematic cross-sectional view of the golf club head of FIG. 1, taken along line 3-3.

Referring to the drawings, wherein like reference numerals are used to identify like or identical components in the various views, FIGS. 1 and 2 schematically illustrate a hollow golf club head 10 that includes a metallic body 12, a club face 14, and a polymeric insert 16. As generally illustrated in FIG. 3, the body 12, face 14, and insert 16 cooperate to at least partially define a closed internal cavity 18. In one particular configuration, the cavity 18 has volume of from about 20 cc to about 120 cc.

Referring again to FIG. 2, the club face 14 is intended to contact the golf ball during a normal swing, and generally includes a plurality of parallel grooves that are recessed into the club face 14 in a generally concave manner. As is commonly understood, the club face 14 is angled (relative to a vertical plane) when the golf club 10 is held in a neutral hitting position. This angle is generally referred to as the loft angle or slope of the club. Wood-type club heads (including hybrid woods) may most commonly have loft angles of from about 8.5 degrees to about 24 degrees, while iron-type club heads may most commonly have loft angles from about 17 degrees to about 64 degrees, though other loft angles are possible and have been commercially sold. A particular subset of iron-type club heads, referred to as "wedges," generally have loft angles of from about 47 degrees to about 64 degrees. The present technology may be of particular importance to iron-type club heads, and more specifically to club heads having loft angles of from about 17 degrees to about 60 degrees, and even more preferably from about 17 degrees to about 47 degrees (i.e., 2-iron through PW) or from about 17 degrees to about 32 degrees (i.e., 2-iron through 7-iron).

In general, hollow club heads allow more weight to be moved to the outer perimeter of the head, which can result in higher moments of inertia and forgiveness to off-center impacts. Additionally, by removing weight from the central/inner region of the club head 10, a club designer has more available discretionary mass to place throughout the club head to achieve a desired feel. Specifically as to irons, hollow irons can provide a design that is generally stiffer than comparable cavity back designs, while being generally more forgiving than muscle back designs.

The metallic body 12 may be formed through any suitable process, including, for example, stamping, forging, or casting. Additionally, the face 14 may either be integrally formed with the body 12, or else may be separately fabricated and affixed to the body 12 through, for example, welding, brazing, or gluing. The body 12 and/or face 14 may be formed from a metal or metal alloy, including, for example, alloys of steel (e.g., AISI type 1020 or AISI type 8620 steel), stainless steel (e.g., AISI type 304, AISI type 431, or AISI type 630 stainless steel) or titanium (e.g., Ti-6Al-4V Titanium alloy), however other metal alloys, metal amorphous alloys, and/or non-metallic materials known in the art may similarly be used.

Figure 4:
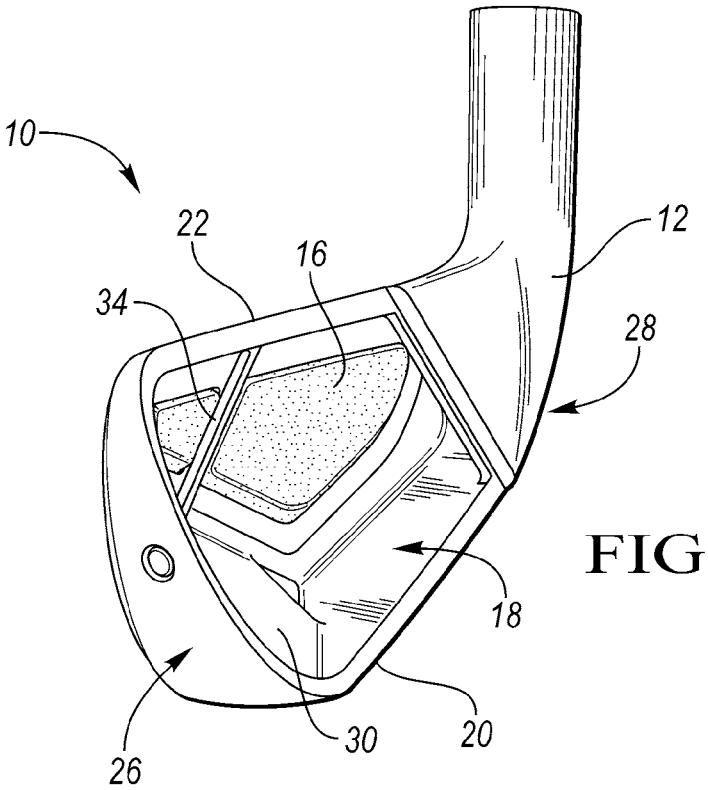
FIG. 4 is a schematic perspective view of the golf club head of claim 2, with the club face removed.

FIG. 4 illustrates a club head with the club face 14 removed (or prior to the club face being affixed) to further illustrate an embodiment of the internal cavity 18. In general the metallic body 12 may include a sole 20, a topline 22, and a rear wall 24. The rear wall 24 is located between the sole 20 and topline 22 and opposite the face 14.

The sole 20 may extend on an underside of the club head 10 such that the sole 20 contacts the ground when the golf club is held in a neutral hitting position. The sole 20 may extend from a toe portion 26 of the club head 10 to a heel portion 28 of the club head 10, and is disposed between the club face 14 and the rear wall 24.

While the sole 20 may generally define the underside of the club head 10, the topline 22 may generally define the upper or top portion of the club head 10. The topline 22 provides structural support or reinforcement for the club face 14, though in a hollow club design, the rear wall 24 can also buttress the topline 22 to aid in providing this support. In general, the sole 20 and topline 22 are disposed on opposing sides of both the club face 14 and the rear wall 24.

To reduce the structural weight of the club head 10 below what was conventionally available with a hollow iron, a portion of the rear wall 24 may be removed and replaced with a comparatively lighter weight polymeric insert 16, such as shown in FIGS. 1, 3, and 4. To promote design flexibility, the polymeric insert may be molded into shape using any of the number of molding techniques, such as, injection molding, compression molding, blow molding, or the like. While weight savings and design flexibility are important, the polymeric material must also be strong enough to withstand the stress that is experienced when the club head 10 impacts a ball. To accomplish this, it is preferable to use a material that has a tensile strength of greater than about 200 MPa (according to ASTM D638), or more preferably greater than about 250 MPa. Additionally, for ease of molding, if the polymeric material is filled, then it desirably has a resin content of greater than about 50%, or even greater than about 55% by weight. One such material may include, for example, a thermoplastic aliphatic or semi-aromatic polyamide that is filled with chopped fiber, such as chopped carbon fiber or chopped glass fiber. Other materials may include polyimides, polyamide-imides, polyetheretherketones (PEEK), polycarbonates, engineering polyurethanes, and/or other similar materials.

Figure 5:
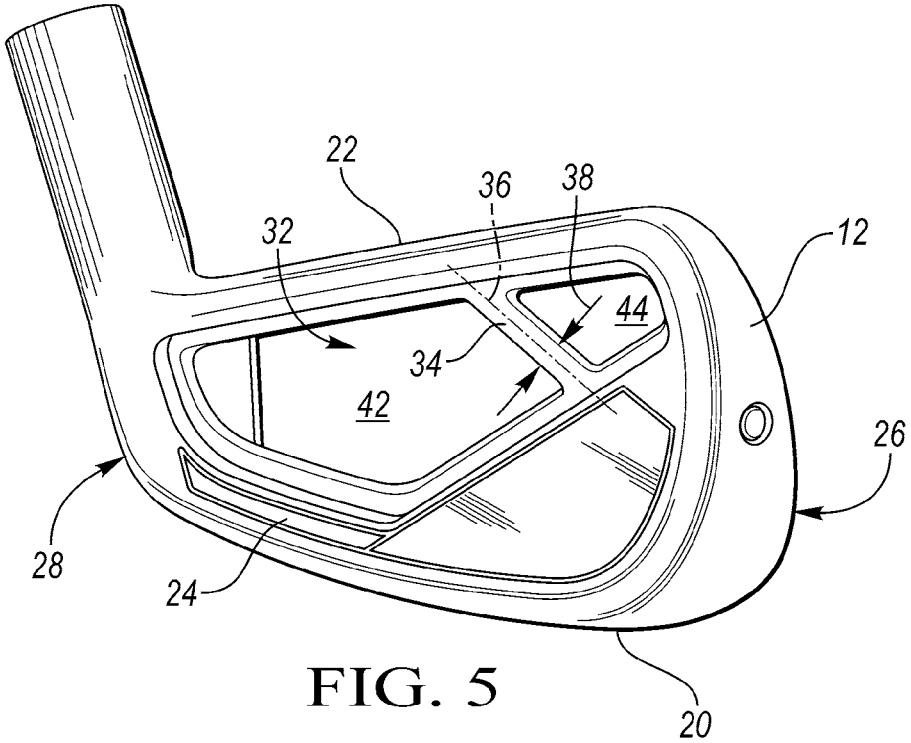
FIG. 5 is a schematic perspective view of a metallic club head body with an opening provided in a rear wall.

As illustrated in FIG. 5, in the present design, the rear wall 24 defines an opening 32 that may be configured to receive the polymeric insert 16. The opening 32 may be positioned within the rear wall 24 to result in a movement of the center of gravity of the clubhead 10 toward the sole 20 and toward the toe portion 26. This may occur by biasing the location of the opening 32 toward the topline 22 and toward the heel portion 28. Movement of the center of gravity may further be caused by repositioning the removed mass (less the weight of the polymeric insert 16) to a weighted toe portion 30 of the club head 10, such as best shown in FIG. 4. In one configuration, the use of the polymeric insert 16 and opening 32 may enable the center of gravity to be moved by from about 0.5 mm to about 2.0 mm toward the sole 20 and/or toe portion 26.

The weighted toe portion 30 may be a region of the toe 26 that includes an increased metal mass specifically for the purpose of increasing swing weight, increasing one or more moments of inertia, or moving the center of gravity of the club head 10. The weighted toe portion may desirably be placed as close to the toe 26 and rear wall 24 as possible. The weighted toe portion preferably includes a metallic mass that is either formed from the metal used to form the body 12, or from a more dense metal, such as tungsten or a tungsten alloy. In one configuration, a portion of the weighted toe portion 30 may be selectively removable, such as by being screwed in place. In another configuration, the weight may be entirely integrated within the club such that it may not be removed without causing damage to the club head 10.

While the opening 32 may provide benefits through weight savings and a movement of the center of gravity down and toward the toe, it also can contribute to a reduction in the structural integrity of the club head 10. The weakened structure is particularly evident in the topline 22, where the opening 32 leaves the generally thin topline face support in suspension between the toe and the heel. Additionally, if a polymer insert 16 is adhered to the body 12, any flexure of the topline 22 could risk weakening the bond between the insert 16 and the body 12, and present durability issues.

To stiffen the body 12 in the vicinity of the opening, one or more struts 34 may extend across the opening 32 and be secured to (or integrally formed with) the body 12. For the purpose of this disclosure, "secured to the body 12" includes securing or integrally forming the strut 34 to the body 12. A strut 34 may be formed as a bar, beam, channel, or rod, and may extend along a longitudinal axis 36. In one particular example, the strut 34 is a T-beam. To provide sufficient structural rigidity, the strut 34 may have a width 38, measured transverse to the longitudinal axis 36 and parallel to the opening 32, of from about 2 mm to about 5 mm, and may have a height, measured transverse to both the longitudinal axis 36 and the opening 32 of from about 2 mm to about 5 mm. For the purpose of this disclosure, dimensional or directional references made of, or with respect to the opening 32 are intended to view the opening 32 as an imaginary surface that is skinned across the void, where the edges of the surface are generally parallel to, and in contact with the rear wall 24.

In one configuration, the strut 34 may extend between the topline 22 and at least one of the toe portion 26 of the club head 10 or the heel portion 28 of the club head 10. Being configured in this manner may provide an additional load-path and/or buttress for the central portion of the topline 22. In one particular configuration, the strut 34 may extend across the opening 32 and between the topline 22 and the weighted toe portion 30 of the club head 10, as shown in FIG. 4. This configuration may aid in stiffening the entire club head 10 by providing additional reinforcement for the cantilevered weight 30.

When the strut 34 extends across the opening 32, the strut 34 may effectively divide the opening 32 into a first opening 42 and a second opening 44, such as shown in FIG. 5. In one configuration, the area of the opening 32 and/or the combined area of the first opening 42 and the second opening 44 may be from about 800 $mm^2$ to about 1200 $mm^2$. The opening 32 and/or rear wall 24 may be oriented such that they are within about 30 degrees of parallel to the face 14 and/or such that a centrally located normal vector of at least one of the first opening 42 or the second opening 44 intersects the club face 14.

While the primary purpose of the strut 34 may be to stiffen the club head 10 after the portion of the rear wall 24 is removed, it may also aid in securing the polymeric insert 16 to the body 12. More specifically, the strut 34 may provide additional surface area for the polymeric insert 16 to be bonded to, while also stiffening the central portion of the insert 16.

In one configuration, the insert 16 is secured to the body 12 through at least a first bond area and a second bond area, where each may include one or more surfaces. The two bond areas may be differentiated by the predominant stress type that an adhesive experiences across the respective area when preventing direct removal of the insert 16. The first bond area generally secures the insert 16 to the body 12 using the tensile or peel strength of a securing adhesive, whereas the second bond area 54 generally secures the insert 16 to the body 12 using the sheer strength of the adhesive. As such, the first bond area may include any bond surface that is within 45 degrees of parallel to the opening 32 and the second bond area may include any bond surface that is within 45 degrees of perpendicular to the opening 32.

Figure 6:
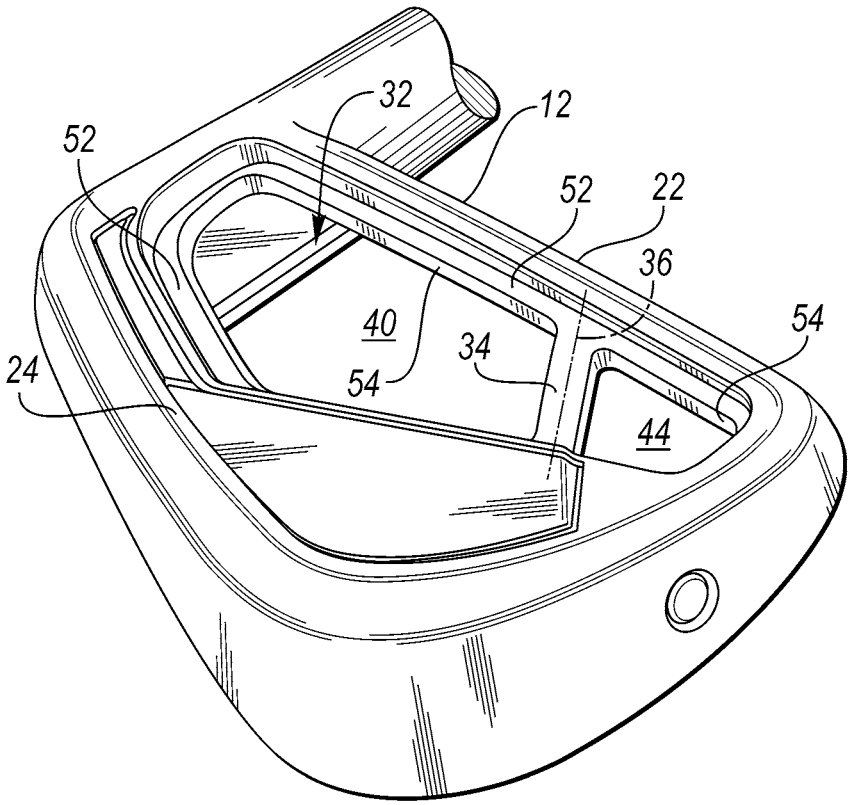
FIG. 6 is a schematic enlarged portion of an opening in a rear wall of a metallic club head body.

In the design shown in FIG. 6, the first bond area may include an outwardly facing surface 52 that is formed both by a ledge extending around the perimeter of the opening 32 and by a portion of the strut 34. When installed, the insert 16 may overlap and be adhered to this outwardly facing surface 52 using a suitable adhesive and/or epoxy.

Additionally, in this design, the second bond area includes one or more sheer bond surfaces 54 that are disposed at an angle relative to the outwardly facing surface 52. In this example, sheer bond surfaces 54 may be internal to the outwardly facing surface 52 and may include the internal perimeter of the first opening 42, the internal perimeter of the second opening 44, which further includes opposing sides of the strut 34. Therefore, in the illustrated design, the strut 34 is operative both to stiffen the body 12 (including the topline) and to aid in securing the insert 16.

In one configuration, each of the first bond area and the second bond area may be from about 250 $mm^2$ to about 500 $mm^2$. Additionally, the ratio of the second bond area to the first bond area may be, for example, from about 0.7:1 to about 2:1, or from about 0.9:1 to about 1.5:1, or even from about 0.95:1 to about 1.3:1. While not preclusive of other ratios that may be design dependent, these particular ratios are found to optimize weight savings and adhesion strength in designs such as shown in the figures.

Figure 7:
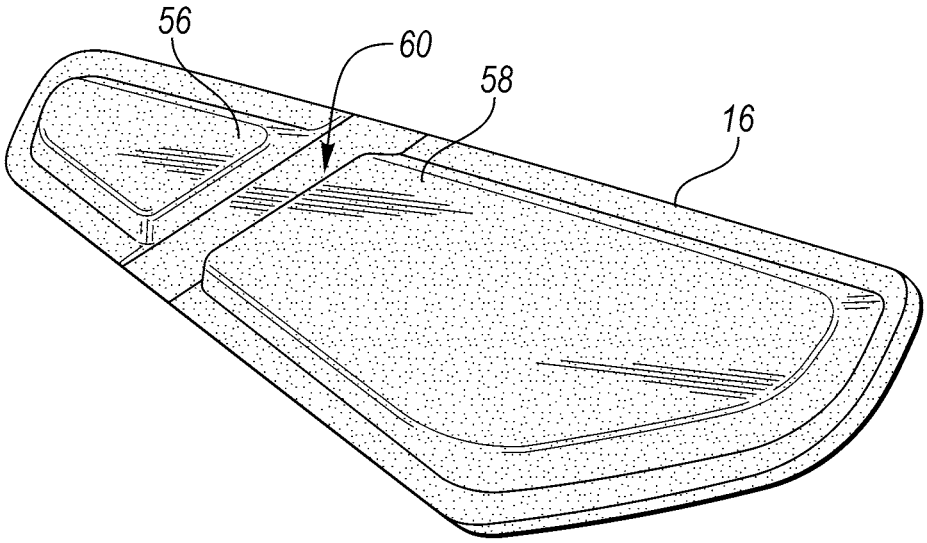
FIG. 7 is a schematic perspective view of a polymeric insert for covering an opening in a rear wall of a metallic club head body.

Referring to FIG. 7, the insert 16 may include two protruding portions 56, 58 that are each are adapted to extend into a respective one of the first opening 42 and second opening 44. These protruding portions 56, 58 generally form a "U"-type channel 60 that receives the strut 34 and bonds with the second bond area.

Once secured in place, the polymer insert 16 may also provide a reinforcing benefit by mechanically supporting the opening 32. For example, in the present design, the frequency of the first vibration mode (i.e., for a 7-iron) increases by about 350 Hz to about 700 Hz simply by affixing the polymeric insert 16 across the opening 32. Likewise, inclusion of the polymer insert 16 may increase the frequency of the second vibration mode (i.e., for a 7-iron) by about 800 Hz to about 1200 Hz.

"A," "an," "the," "at least one," and "one or more" are used interchangeably to indicate that at least one of the item is present; a plurality of such items may be present unless the context clearly indicates otherwise. All numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; about or reasonably close to the value; nearly). If the imprecision provided by "about" is not otherwise understood in the art with this ordinary meaning, then "about" as used herein indicates at least variations that may arise from ordinary methods of measuring and using such parameters. In addition, disclosure of ranges includes disclosure of all values and further divided ranges within the entire range. Each value within a range and the endpoints of a range are hereby all disclosed as separate embodiment.

The terms "comprises," "comprising," "including," and "having," are inclusive and therefore specify the presence of stated items, but do not preclude the presence of other items. As used in this specification, the term "or" includes any and all combinations of one or more of the listed items. When the terms first, second, third, etc. are used to differentiate various items from each other, these designations are merely for convenience and do not limit the items.

The invention claimed is:

1. A hollow golf club head comprising:

a metallic body including a sole, a topline, and a rear wall defining an opening, wherein the rear wall is disposed between the topline and the sole;

a club face disposed between the topline and the sole, and on an opposite side of the sole from the rear wall;

a strut extending across the opening and secured to the body;

a polymeric insert defining a channel, wherein the polymeric insert is adhered to an outer surface of the body such that the insert covers the opening and such that the strut extends within the channel; and wherein the body, the club face, and the polymeric insert define a closed internal cavity therebetween.

2. The golf club head of claim 1, wherein the club face has a loft angle of from about 17 degrees to about 60 degrees.

3. The golf club head of claim 1, wherein the body includes a first bond area and a second bond area that each respectively encircle at least a portion of the opening;

wherein the first bond area is within 45 degrees of parallel to the opening, and wherein the second bond area is within 45 degrees of perpendicular to the opening; and wherein the polymeric insert is adhered to both the first bond area and the second bond area using an adhesive.

4. The golf club head of claim 3, wherein the ratio of the size of the second bond area to the size of the first bond area is from about 0.7:1 to about 2.0:1.

5. The golf club head of claim 1, wherein the polymeric insert is adhered to opposing sides of the strut.

6. The golf club head of claim 1, wherein the closed internal cavity has a volume of from about 20 cc to about 120 cc.

7. The golf club head of claim 1, wherein the strut divides the opening into a first opening and a second opening; and wherein the polymeric insert extends within each of the first opening and the second opening.

8. The golf club head of claim 7, wherein the first opening and the second opening have a combined area of from about 800 $mm^2$ to about 1200 $mm^2$.

9. The golf club head of claim 1, wherein the strut is integrally formed with the metallic body and is operative to stiffen the topline.

10. The golf club head of claim 9, wherein the metallic body further includes a weighted toe portion of the sole; and wherein the strut extends between the weighted toe portion of the sole and a central portion of the topline.

11. A hollow golf club head comprising:

a metallic body including a sole, a topline, and a rear wall defining an opening having an area of from about 800 $mm^2$ to about 1200 $mm^2$, wherein the rear wall is disposed between the topline and the sole;

a club face disposed between the topline and the sole, and on an opposite side of the sole from the rear wall, wherein the club face is disposed at a loft angle of from about 17 degrees to about 60 degrees;

a strut extending across the opening and secured to the body;

a polymeric insert defining a channel, wherein the polymeric insert is adhered to an outer surface of the body and strut such that the insert covers the opening and such that the strut extends within the channel; and wherein the body, the club face, and the polymeric insert define a closed internal cavity therebetween.

12. The golf club head of claim 11, wherein the body includes a first bond area and a second bond area;

wherein the first bond area is within 45 degrees of parallel to the opening, and wherein the second bond area is within 45 degrees of perpendicular to the opening; and wherein the polymeric insert is adhered to both the first bond area and the second bond area using an adhesive.

13. The golf club of claim 12, wherein the ratio of the size of the second bond area to the size of the first bond area is from about 0.7:1 to about 2.0:1.

14. The golf club of claim 11, wherein the polymeric insert is adhered to opposing sides of the strut.

15. The golf club of claim 11, wherein the closed internal cavity has a volume of from about 20 cc to about 120 cc.

16. The golf club of claim 11, wherein the strut is integrally formed with the metallic body and is operative to stiffen the topline.

17. The golf club of claim 16, wherein the metallic body further includes a weighted toe portion; and wherein the strut extends between the weighted toe portion and the topline.

* * * * *